US006877422B2

(12) United States Patent
Hisanobu et al.

(10) Patent No.: US 6,877,422 B2
(45) Date of Patent: Apr. 12, 2005

(54) MECHANICAL PRESS

(75) Inventors: Kanamaru Hisanobu, Kanagawa (JP); Takao Ito, Kanagawa (JP)

(73) Assignee: Aida Engineering Co., Ltd., Kanagawa (JP)

( * ) Notice: Subject to any disclaimer, the term of this patent is extended or adjusted under 35 U.S.C. 154(b) by 0 days.

(21) Appl. No.: 10/349,902

(22) Filed: Jan. 23, 2003

(65) Prior Publication Data

US 2003/0200878 A1 Oct. 30, 2003

(30) Foreign Application Priority Data

Apr. 26, 2002 (JP) ..... 2002-125338

(51) Int. Cl.[7] ..... B30B 1/26

(52) U.S. Cl. ..... 100/257; 100/289; 72/441; 72/452.5

(58) Field of Search ..... 100/256, 257, 100/258 R, 258 A, 280, 287, 289, 291; 72/441, 452.1, 452.5, 452.7, 446

(56) References Cited

U.S. PATENT DOCUMENTS

| | | | | |
|---|---|---|---|---|
| 2,984,175 A | | 5/1961 | Wahl | |
| 4,096,728 A | | 6/1978 | Glecker | |
| 5,609,056 A | * | 3/1997 | Seeber | 72/446 |
| 5,894,755 A | * | 4/1999 | Seeber et al. | 72/441 |
| 6,595,122 B1 | * | 7/2003 | Mukai et al. | 100/46 |

FOREIGN PATENT DOCUMENTS

| | | |
|---|---|---|
| GB | 1460986 A1 | 1/1977 |
| JP | 55-48500 | 4/1980 |
| JP | 57-14499 | 1/1982 |
| JP | 06-269996 | 9/1994 |

* cited by examiner

*Primary Examiner*—Allen Ostrager
*Assistant Examiner*—Jimmy Nguyen
(74) *Attorney, Agent, or Firm*—Darby & Darby

(57) ABSTRACT

The present invention provides a mechanical press with a low height. A sliding guide mechanism and a position adjusting mechanism are provided on the upper and lower sides of an adjustor member, respectively. The sliding guide mechanism converts the rotating motion of an eccentric part of a crankshaft into a reciprocating linear motion and is provided above the adjustor member. The position adjusting mechanism adjusts the position of the slide and is provided below the adjustor member.

6 Claims, 5 Drawing Sheets

FIG. 3
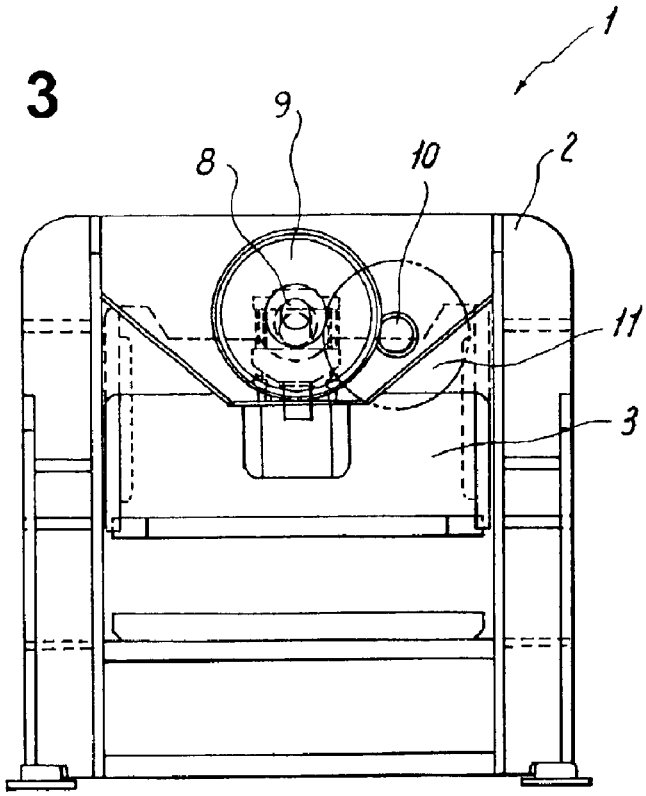
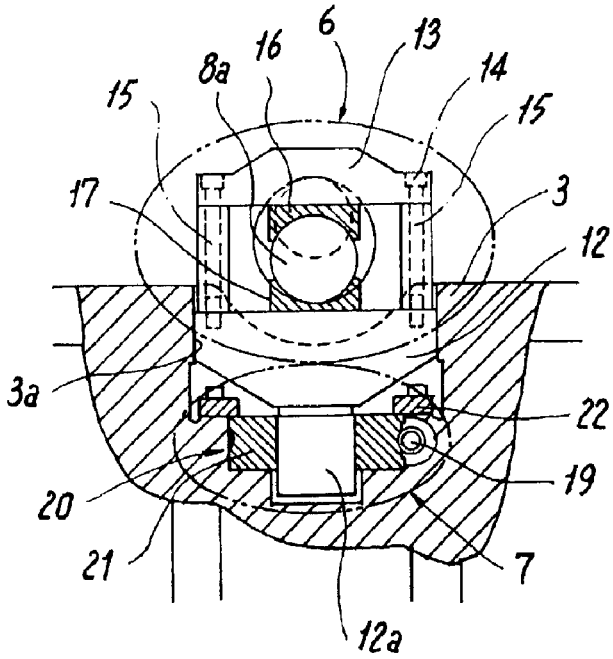
FIG. 4

MECHANICAL PRESS

FIELD OF THE INVENTION

The present invention relates to a mechanical press with a low height.

BACKGROUND OF THE INVENTION

A typical mechanical press is shown in FIG. 6 and includes an eccentric part 8*a* of a crankshaft which is connected by a connecting rod 23 to a slide 3. An adjustor screw 24 for adjusting the slide 3 is located between the connecting rod 23 and the slide 3. The distance between the crankshaft and the slide 3 cannot be shortened due to the presence of the connecting rod 23. Therefore, the total height of the mechanical press must include the height of the connecting rod 23.

Japanese Laid-Open Patent Number 55-48500 discloses a mechanical press without a connecting rod. The height of the mechanical press is lower since there is no connecting rod. However, this mechanical press lacks an adjustor screw for slide adjustment, and a mechanical press is inconvenient to operate without an adjustor screw.

Japanese Laid-Open Patent Publication Number 06-269996 discloses a bushing and a slide which are fitted to the eccentric part of a crankshaft. The slide slides inside a connecting rod which is guided in the vertical direction by a guide bushing provided on a crown part. The connecting rod and the slide are connected by a die height adjusting mechanism. The slide is prevented from being raised above the guided part of the connecting rod since the connecting rod is guided by the crown part. Therefore, the height of the machine cannot be lowered.

Japanese Laid-Open Patent Publication Number 57-14499 discloses a guide plate which is guided by a guide. The slide cannot move higher than the guide, and the distance between the crankshaft and the slide cannot be shortened. It would be difficult to lower the height of this mechanical press.

A connecting rod or a member associated with the connecting rod prevents lowering the height of a mechanical press. Press operations are difficult to perform on mechanical presses whose height can be lowered.

SUMMARY OF THE INVENTION

The present invention provides a mechanical press with a low height that is convenient to use. A sliding guide mechanism and a position adjusting mechanism are provided on the upper and lower sides of an adjustor member, respectively. The sliding guide mechanism converts the rotating motion of an eccentric part of a crankshaft into a reciprocating linear motion and is provided above the adjustor member. The position adjusting mechanism adjusts the position of the slide and is provided below the adjustor member.

A sliding guide mechanism converts the rotating motion of the eccentric part of the crankshaft into a linear reciprocating motion by working with the slide of the mechanical press. The position adjusting mechanism is prevented from rotating with respect to the slide. However, the position adjusting mechanism can advance and retreat with respect to the slide.

The position adjusting mechanism can be a screw mechanism which comprises a screw shaft on the adjustor member and a nut which screws onto the screw shaft. The nut can rotate and is prevented from moving relative to the slide.

The sliding guide mechanism can be provided on an upper side of the position adjusting mechanism. The sliding guide mechanism comprises a slider that connects to the eccentric part of the crankshaft and a framework which houses the slider in a freely sliding manner.

The slider can be separated and can comprise an upper slider which connects to an upper side of the eccentric part of the crankshaft and a lower slider which connects to a lower side of the eccentric part of the crankshaft.

The objects, features, and advantages of the present invention will become apparent from the following description read in conjunction with the accompanying drawings, in which like reference numerals designate the same elements.

BRIEF DESCRIPTION OF THE DRAWINGS

FIG. 3 is a rear view of a partial cross-section of a mechanical press of the present invention.

FIG. 4 is an enlarged view of the principal parts of a mechanical press of the present invention.

DETAILED DESCRIPTION OF THE PREFERRED EMBODIMENTS

Figure 1:
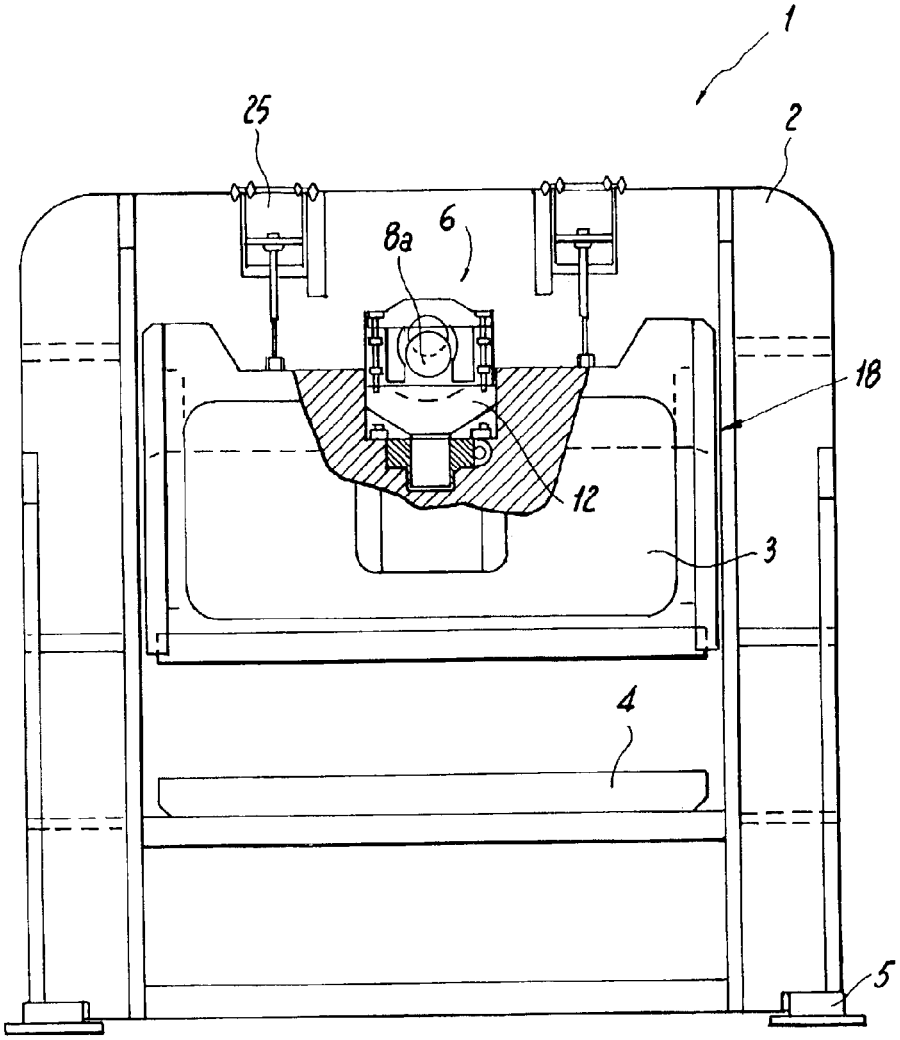
FIG. 1 is a front view of a partial cross-section of a mechanical press of the present invention.

A slide 3 is provided on a frame 2 of a mechanical press 1 as shown in FIG. 1 so that the slide 3 can be raised and lowered. A bolster 4 is attached to the frame 2 so that it is positioned opposite to the slide 3. A vibration-proof piece 5 is attached to the lower end of the frame 2 and blocks the vibration of the mechanical press 1 at the foundation.

The slide 3 is guided by a slide guide 18 and is raised and lowered with respect to the frame 2. The slide 3 is pulled up by a balancer 25 which is constructed from an air cylinder device. The balancer 25 balances the weight of the slide 3 and an upper mold which is attached to the lower surface of the slide 3.

Figure 2:
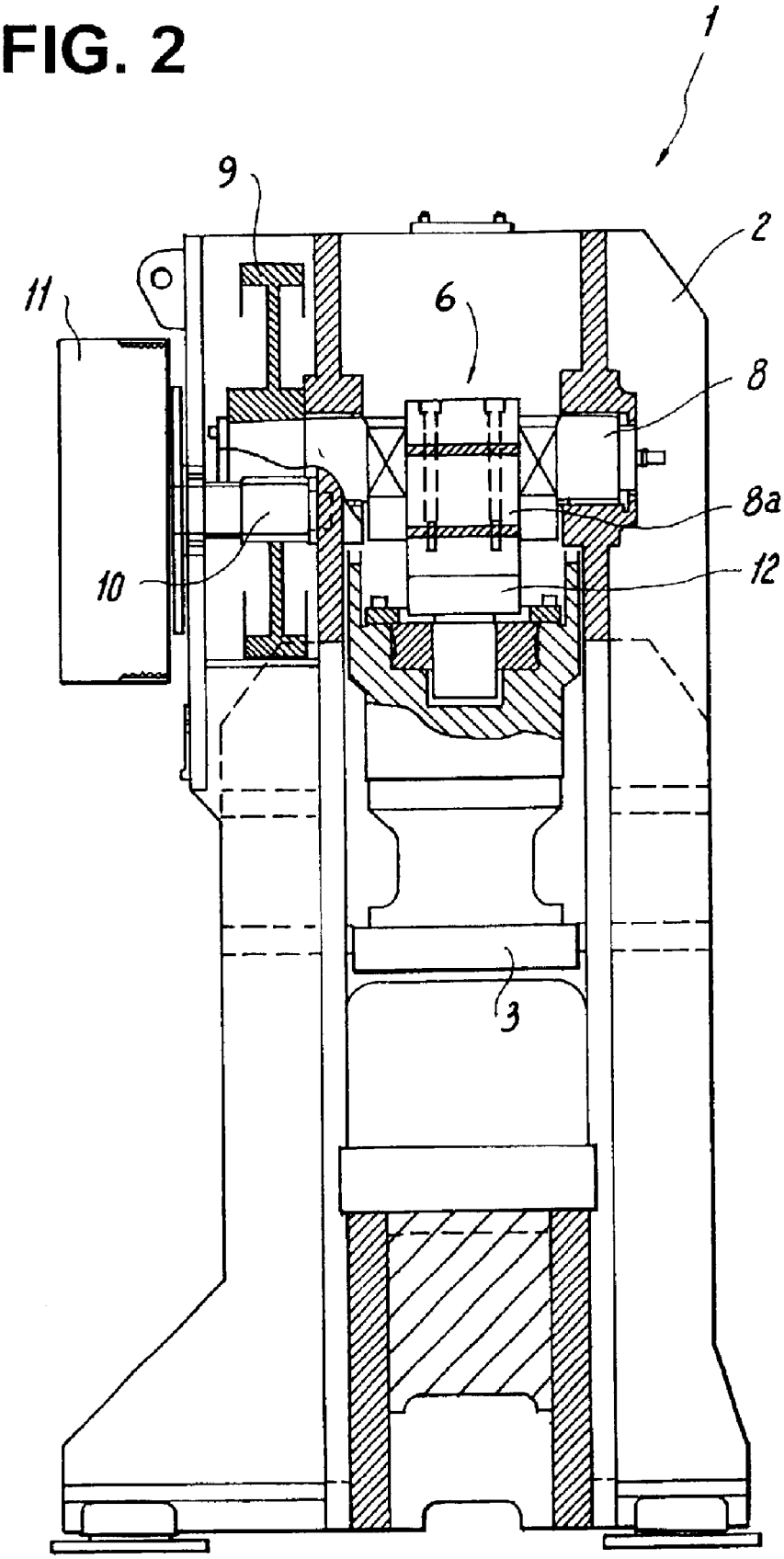
FIG. 2 is a left side view of a partial cross-section of a mechanical press of the present invention.

A crankshaft 8 is provided on the frame 2 as shown in FIG. 2 and is supported rotatably by a bearing provided on the frame 2. The crankshaft 8 is positioned in the front-back direction with respect to the frame 2.

A main gear 9 is attached to the crankshaft 8. A flywheel 11 is provided on the frame 2 and is rotated by a motor (not shown). A pinion gear 10 is formed on a shaft provided on a clutch brake located inside the flywheel 11. The pinion gear 10 engages with the main gear 9.

The crankshaft 8 is rotated by a driving mechanism which is constructed from the motor, the flywheel 11, the clutch brake, the pinion gear 10, the main gear 9, and the like.

The flywheel 11 has a relatively large diameter as shown in FIG. 3. Therefore, the flywheel 11 is placed near the end of the crankshaft 8. By incorporating the flywheel 11 in the mechanical press 1 near the end of the crankshaft 8, the height of the frame 2 is lowered, thereby lowering the height of the mechanical press 1.

A sliding guide mechanism 6 and a position adjusting mechanism 7 are provided together on an adjustor member 12 as shown in FIG. 4. The sliding guide mechanism 6 is provided on the upper side of adjustor member 12, and the position adjusting mechanism 7 is provided on the lower side of adjustor member 12. A cap 13 interposes spacers 15 and is attached to the adjustor member 12 by a bolt 14. A framework, which has a space in the center, is created with the adjustor member 12, the spacers 15, and the cap 13.

An eccentric part 8*a* of the crankshaft 8, an upper slider 16, and a lower slider 17 are housed in the space in the center of the framework. The upper slider 16 and the lower slider 17 are joined above and below the eccentric part 8*a* of the crankshaft 8, respectively. The eccentric part 8*a* of the crankshaft 8 slides freely as it is held within the upper slider 16 and the lower slider 17, which are positioned between the cap 13 and the adjustor member 12. The sliding guide mechanism 6 is constructed from the upper slider 16, the lower slider 17, the adjustor member 12, the cap 13, the spacer 15, and the like. The upper slider 16 and the lower slider 17 move horizontally relative to each other with respect to the framework. The upper slider 16 and the lower slider 17 slide freely with respect to the framework.

The slider can be separated and can comprise the upper slider 16 and the lower slider 17. There are advantages to a separated slider in contrast to a unitary slider. Additional space for a bolt to unify the upper and lower sliders is unnecessary, and therefore, the slider can be narrower. Furthermore, the clearance inside and outside the slider can be halved.

A nut 21 is screwed onto a screw shaft 12a which is formed on the lower end of the adjustor member 12. The nut 21 can rotate on the slide 3, but the vertical movement of the nut 21 is restricted. The nut 21 is retained on the slide 3 by a retainer 22. A worm gear 20 is formed on the perimeter of the nut 21 and engages a worm shaft 19. The worm shaft 19 rotates on the slide 3 and is rotated by a motor (not shown). The position adjusting mechanism 7 is constructed by the screw shaft 12*a*, the nut 21, the worm gear 20, the worm shaft 19, and the like. The position adjusting mechanism 7 corresponds to the slide adjusting means.

The position adjusting mechanism 7 uses a screw mechanism, but it can also use hydraulic pressure. A hydraulic cylinder can be provided on the lower side of the adjustor member 12. The adjustor member 12 can advance or retreat with respect to the slide 3 by controlling the amount of oil in the hydraulic cylinder. Alternatively, a taper block can be placed under the adjustor member 12 so that the adjustor member 12 can advance or retreat with respect to the slide 3.

The adjustor member 12 is guided by the slide 3 in order to prevent accidental rotation. It is necessary to prevent changes in the slide adjustment amount due to accidental rotation of the adjustor member 12 during operation. Guide hole 3*a*, which can be a square-shaped hole in the slide 3, allows the adjustor member 12 to move in the vertical direction with respect to the slide 3 and prevents the rotation of the adjustor member 12. The adjustor member 12 is guided directly by the slide 3. However, there can be an insertion in the slide 3 that can be used to guide the adjustor member 12.

Figure 5:
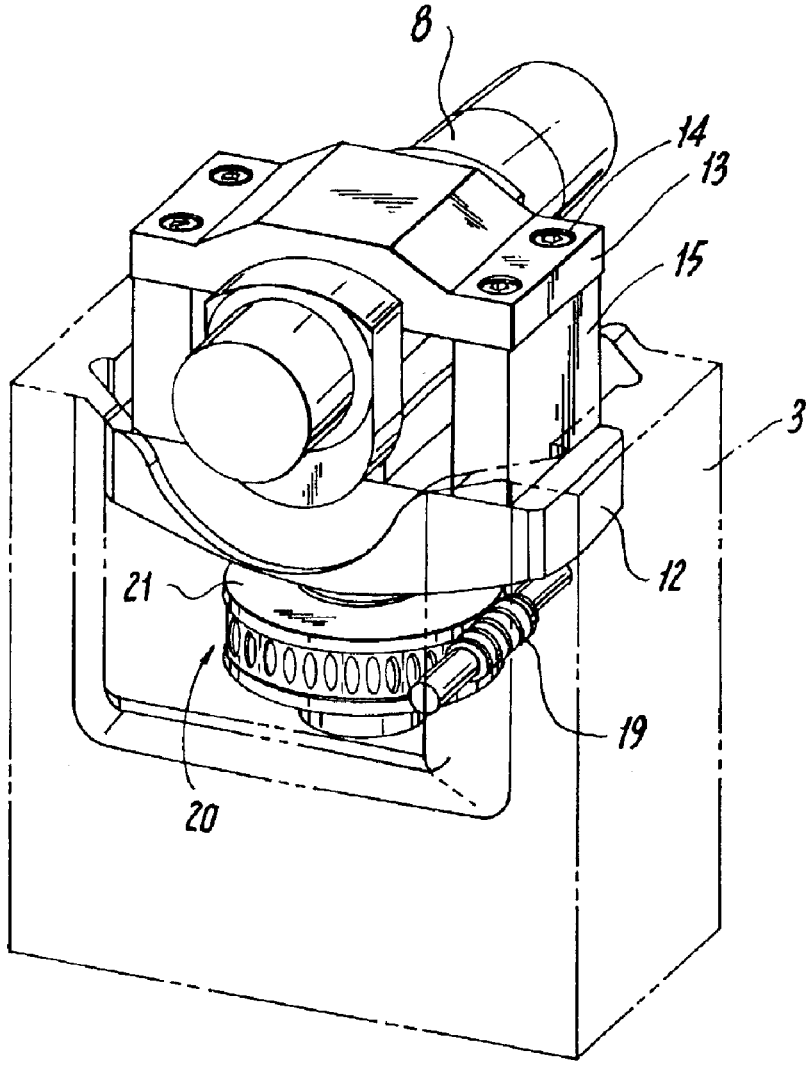
FIG. 5 is a perspective view of the principal parts of a mechanical press of the present invention.
Figure 6:
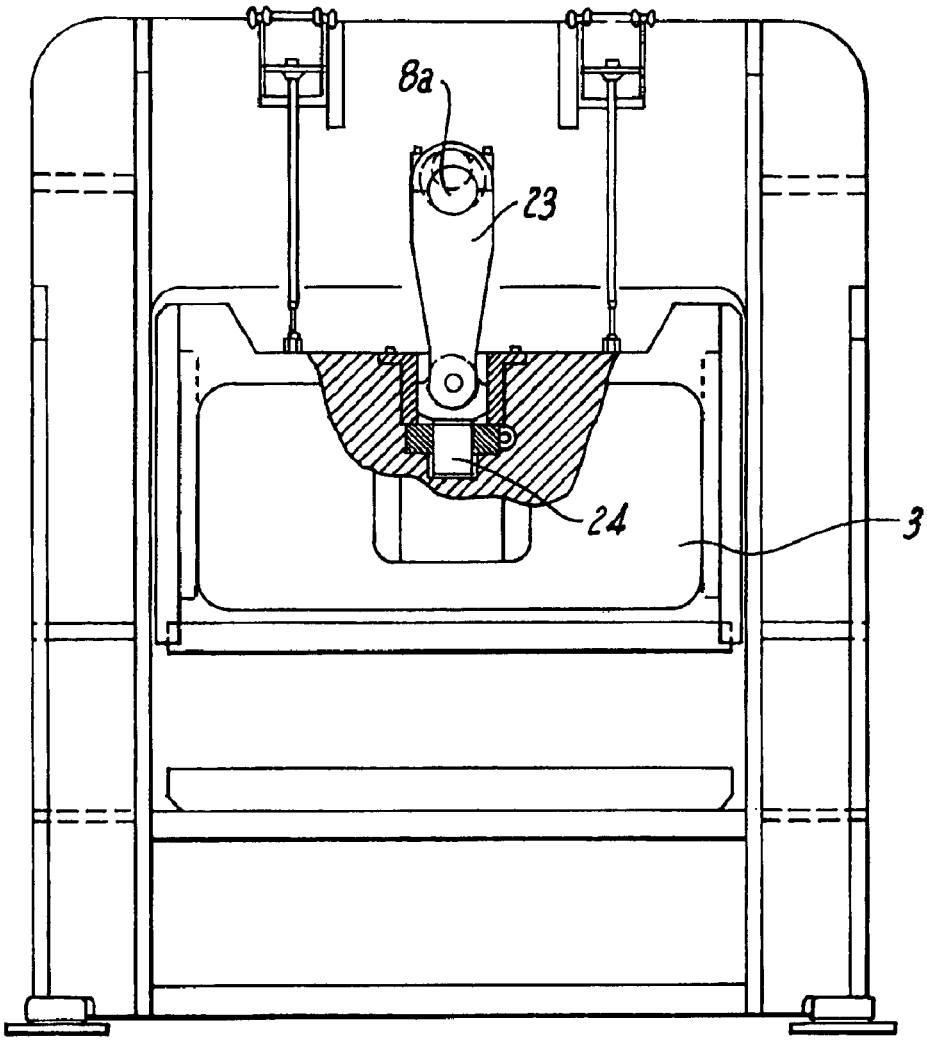
FIG. 6 Prior Art
FIG. 6 is a front view of a partial cross-section of a mechanical press of the prior art with a connecting rod.

FIG. 5 is a perspective view of a mechanical press 1 with a partial cutaway of slide 3. The slide 3 is at the bottom dead center position in FIG. 5 since the crank angle is 180°.

The worm gear 20 and the nut 21 rotate when the worm shaft 19 rotates. The adjustor member 12 is raised and lowered with respect to the slide 3 by the screw mechanism. The displacement amount of the adjustor member 12 equals the slide adjustment amount of the mechanical press 1.

A member such as the connecting rod of the prior art is unnecessary. Therefore, the slide can be positioned higher by a distance corresponding to the length of the unnecessary connecting rod, and the height of the mechanical press can be lowered. Additionally, the vertical and horizontal rigidity of the mechanical press increases. Therefore, the mechanical press does not require a tall housing. Furthermore, the press operation is precise.

Having described preferred embodiments of the invention with reference to the accompanying drawings, it is to be understood that the invention is not limited to those precise embodiments. Various changes and modifications may be effected by one skilled in the art without departing from the scope or spirit of the invention as defined in the appended claims.

What is claimed is:

1. A mechanical press, comprising:

a frame;

a slide raised and lowered with a vertical motion with respect to said frame;

a crankshaft disposed on said frame, said crankshaft comprising an eccentric part;

an adjustor member having an upper and a lower side;

a sliding guide mechanism on said upper side of said adjustor member, said sliding guide mechanism being adapted to convert a rotation motion of said eccentric part of said crankshaft into a reciprocating linear motion, said sliding guide mechanism comprising an upper slider and a lower slider, said eccentric part of said crankshaft being adapted to transfer motion to said upper slider and said lower slider; and a position adjusting mechanism on said lower side of said adjustor member, said position adjusting mechanism being adapted to allow a vertical positional adjustment of said slide while said position adjusting mechanism is prevented from rotating with respect to said slide, wherein said rotational motion of said eccentric part of said crankshaft is converted to said linear motion by said lower slider and said upper slider to enable said vertical motion of said slide.

2. A mechanical press as described in claim 1, wherein said position adjusting mechanism comprises:

a screw mechanism, said screw mechanism comprising a screw shaft on said adjustor member; and a nut which screws onto said screw shaft, said nut being adapted to rotate and being prevented from moving relative to said slide.

3. A mechanical press as described in claim 2, wherein said sliding guide mechanism comprises:

a slider joined with said eccentric part of said crankshaft;

the slider comprising said upper slider and said lower slider;

a framework freely slidably housing said slider, said framework comprising said adjustor member, spacers disposed on said adjustor member, and a cap disposed on said spacers;

said lower slider sliding against said upper side of said adjustor member; and said upper slider sliding against a lower surface of said cap, said lower surface of said cap being secured to upper surfaces of said spacers.

4. A mechanical press as described in claim 3, wherein said slider comprises:

an upper slider which joins with an upper side of said eccentric part of said crankshaft; and said lower slider which joins with a lower side of said eccentric part of said crankshaft.

5. A mechanical press as described in claim 1, wherein said slide comprises a guide hole for preventing said position adjusting mechanism from rotating with respect to said slide.

6. A mechanical press as described in claim 2, wherein said slide comprises a retainer for preventing said nut from moving relative to said slide.

* * * * *

UNITED STATES PATENT AND TRADEMARK OFFICE

CERTIFICATE OF CORRECTION

PATENT NO. : 6,877,422 B2
DATED : April 12, 2005
INVENTOR(S) : Hisanobu Kanamaru et al.

It is certified that error appears in the above-identified patent and that said Letters Patent is hereby corrected as shown below:

Title page,
Item [75], Inventor, delete "Kanamaru Hisanobu, Kanagawa (JP)" and substitute -- Hisanobu Kanamaru, Kanagawa (JP) --.

Signed and Sealed this

Fourteenth Day of June, 2005

JON W. DUDAS
*Director of the United States Patent and Trademark Office*